US005564482A

United States Patent [19]

Grat et al.

[11] Patent Number: 5,564,482

[45] Date of Patent: Oct. 15, 1996

[54] METHOD AND APPARATUS FOR TRANSFERRING A PREDETERMINED PORTION OF PRODUCT TO A CONTAINER

[75] Inventors: Felix R. Grat, Parsippany; Gil M. Foulon, Wanaque, both of N.J.

[73] Assignee: Howden Food Equipment, Inc., Boston, Mass.

[21] Appl. No.: 297,616

[22] Filed: Aug. 29, 1994

[51] Int. Cl.[6] ..... B65B 3/00

[52] U.S. Cl. ..... 141/133; 141/131; 141/145; 141/135

[58] Field of Search ..... 141/131–133, 141/134, 135, 144, 145, 147

[56] References Cited

U.S. PATENT DOCUMENTS

| | | | |
|---|---|---|---|
| 2,055,075 | 9/1936 | Gardner | 141/133 |
| 2,329,776 | 9/1943 | Mondloch | 141/145 X |
| 2,888,962 | 6/1959 | Ammon | 141/145 X |
| 2,922,444 | 1/1960 | Minard | 141/145 X |
| 4,304,085 | 12/1981 | Ross | 141/131 X |
| 4,865,092 | 9/1989 | Reichlet | 141/144 X |
| 5,010,929 | 4/1991 | Tisma | 141/144 X |

*Primary Examiner*—J. Casimer Jacyna
*Attorney, Agent, or Firm*—John Q. Mc Quillan

[57] ABSTRACT

The disclosure relates to apparatus for delivering a predetermined portion of product to a plurality of containers. The apparatus includes a driven endless conveyor having a plurality "of" horizontal flat plates pivotally connected to one another. Fences extend along the length of each of the opposite sides of the endless conveyor adjacent the upper surface portion of each plate to confine product upon the upper surfaces of the plates as the conveyor is driven. Each of the plates has an opening extending therethrough. A cup having an open top portion, an open bottom portion, and a predetermined volume therein is disposed in the opening of each of the plates with the open top portion of the cup in register with the opening in the plate. Means are provided for closing the bottom portion of the cups. Means are provided along the path of travel of the endless conveyor for delivering product to the upper surfaces of the plates and thereby to the cups. Empty containers are advanced beneath the path of travel of the bottom portion of each of the plurality of cups to receive the predetermined portions of product from the cups. Operating the closure for the bottom portion of each the plurality of cups releases the predetermined portion of product to each of the plurality of containers.

31 Claims, 7 Drawing Sheets

METHOD AND APPARATUS FOR TRANSFERRING A PREDETERMINED PORTION OF PRODUCT TO A CONTAINER

BACKGROUND OF THE INVENTION

1. Field of the Invention

The invention relates to a filling machine for delivering a predetermined amount of product such as food product to empty containers while the containers are moving through the machine. The machine has a plurality of cavities which receive the food product. The volume of each of the cavities determines the predetermined portion of product which is to be delivered to each empty container as the container travels through the machine. The volume of each cavity can be adjusted in order to set the quantity of the predetermined portion of product to be delivered to each container.

2. Description of the Prior Art

Machines which are adapted to transfer a predetermined portion of the product to containers are often referred to as volumetric fillers.

Prior art machines are often constructed as rotary style machines having a large cylindrical-shaped hopper or round tub which has cavities arranged in a circular array on the bottom portion of the hopper. The cavities are typically cylindrical in shape and means are provided for closing off the bottom face of each cavity in order the cavity may be filled with the predetermined portion of product. The cavities are commonly referred to as "product cups". Most volumetric fillers have product cups formed by two telescoping cylinders which enable the volume of the cup to be adjusted, thereby determining the quantity of product which can be held within the cup. The product to be filled is introduced into a rotating hopper where it is carried by the hopper bottom in a horizontal circular path. Fixed wiper devices along the circular path direct the product into the product cup cavities. The wipers also direct food product away from the cavities, thereby wiping excess product from the top portion of each of the cavities. The food product within the product cup is then transferred into an empty container which is travelling below the product cup. The contents of the product cup is retained during filling by either a horizontal sliding gate or a fixed plate disposed along the path of the cups. The fixed plate contains an open section to enable the contents of the cup to be delivered to the container.

SUMMARY OF THE INVENTION

In accordance with the invention, there is provided apparatus for delivering a predetermined quantity of product to a plurality of containers. The apparatus includes an endless conveyor having a plurality of flat plates mounted adjacent to one another with the upper surface of each plate disposed in a substantially horizontal plane. Each of the plurality of plates to the plates pivotally connected adjacent thereto. The conveyor is driven to move in the substantially horizontal plane. Fences extending along the length of each of the opposite sides of the endless conveyor to the plates adjacent the upper surface portion of each plate confine product upon the upper surfaces of the plates as the conveyor is driven. Each of being has an opening extending therethrough from the top surface of each plate to the bottom portion thereof. A plurality of cups are provided having an open top portion, an open bottom portion, and a predetermined volume therein. Each of the cups is disposed in the opening of each different one of the plates with the open top portion of the cup in register with the opening in the plate. Means are provided for closing the bottom portion of each the plurality of cups. Means are provided at a predetermined location along the path of travel of the endless conveyor for delivering product to the upper surfaces of the plates of the endless conveyor. Means are disposed beneath the path of travel of the bottom portion of each of the plurality of cups and extending along a portion of the length of the path of travel of the plurality of containers to receive the predetermined portions of product. Means are also provided for enabling the closing means for the bottom portion of each the plurality of cups to release the predetermined portion of product to each of the plurality of containers. The endless conveyor is driven in the substantially horizontal plane and receives the product on the upper surfaces of the plates of the conveyor, thereby enabling the product to be received into the plurality of cups which determine the predetermined portion of product to be delivered to each of the containers. By opening the bottom portion of each the plurality of cups, the predetermined portion of product within each cup can be delivered to each empty container being advanced through the apparatus.

DESCRIPTION OF THE PREFERRED EMBODIMENTS OF THE INVENTION

Figure 1:
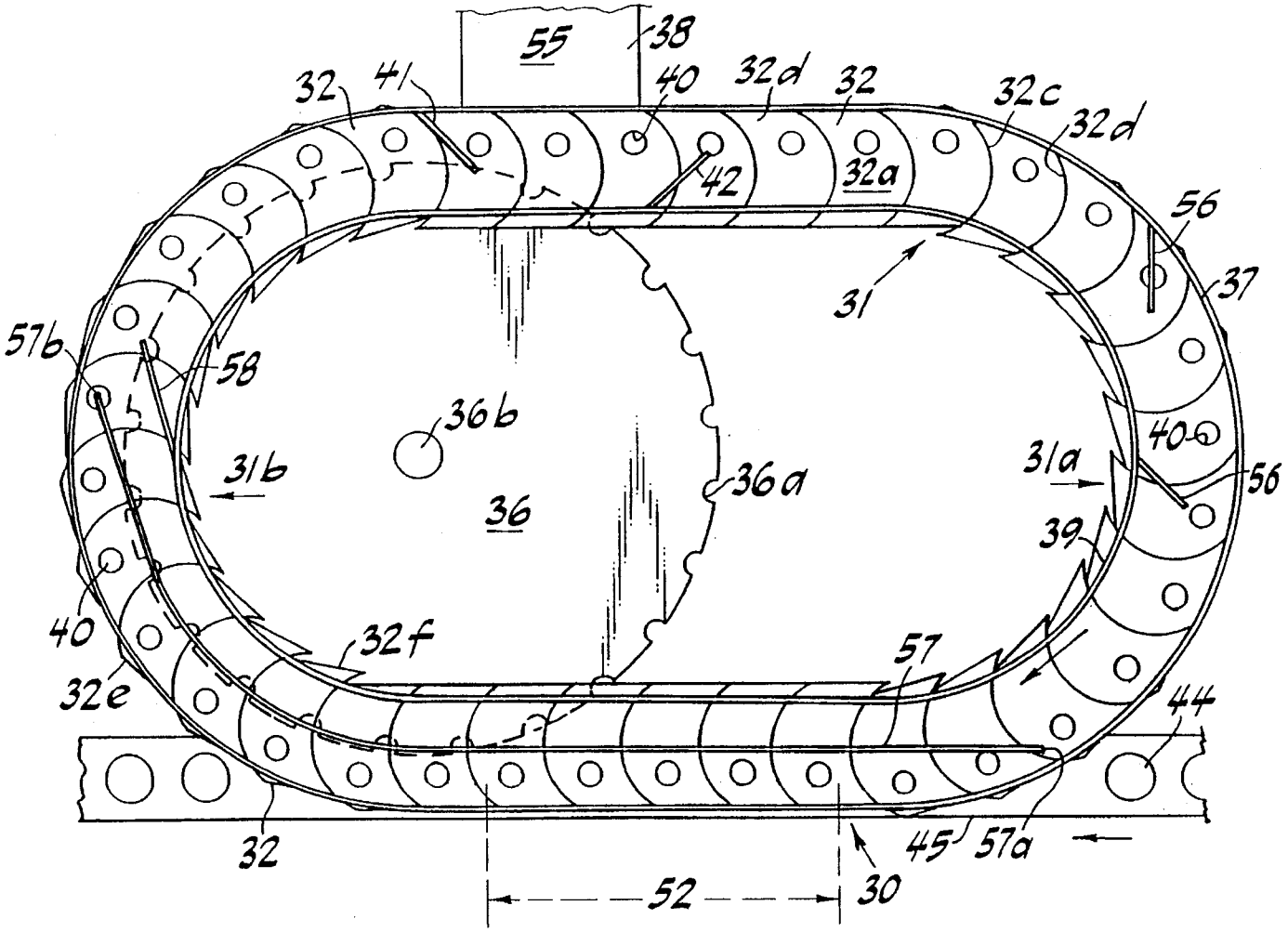
FIG. 1 is a plan view of the endless conveyor of the apparatus of the invention showing the means for advancing the plurality of containers to receive the predetermined quantity of product from the cups of the plates of the endless conveyor.
Figure 2:
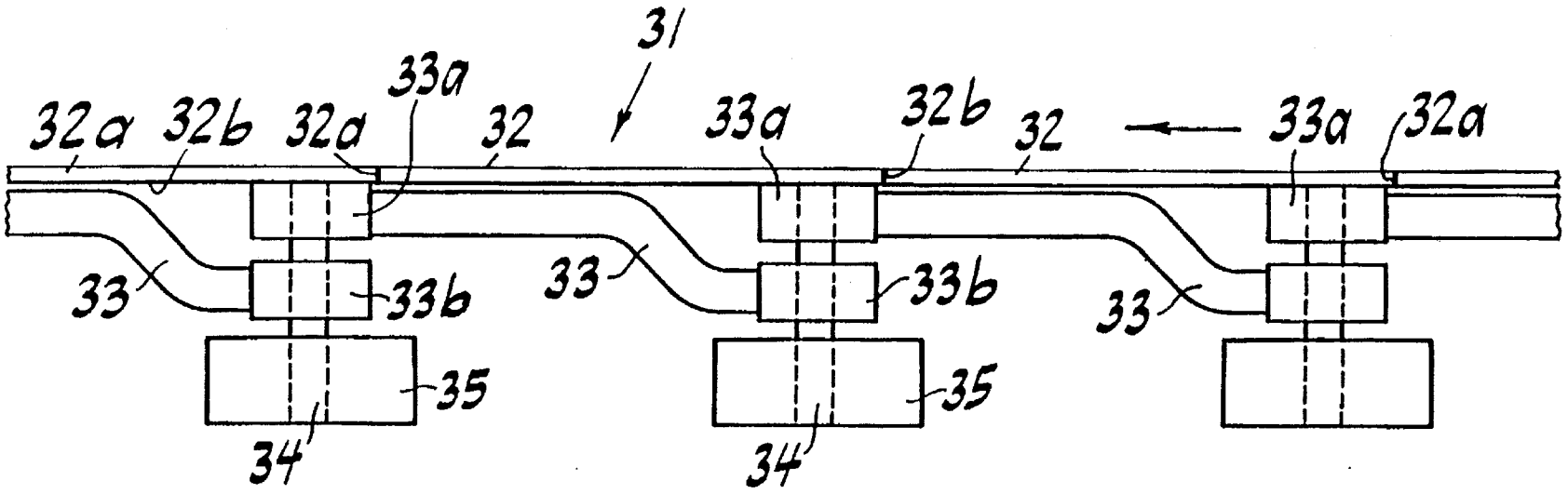
FIG. 2 is an elevation view showing the endless conveyor, the plurality of plates thereof, and the pivotal connection of each of the plates to the plates adjacent thereto.
Figure 3:
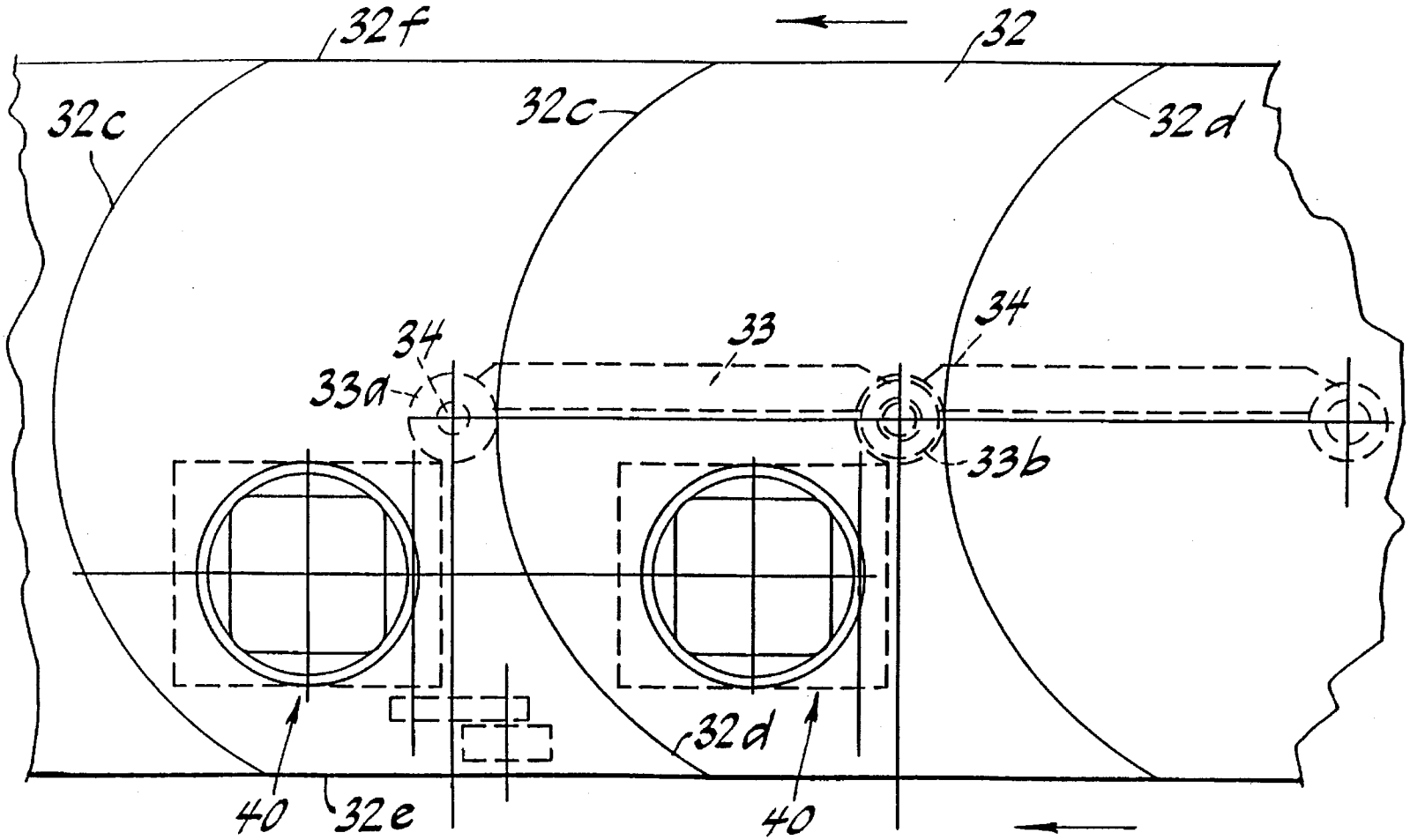
FIG. 3 is a fragmentary plan view showing the flat plates of the endless conveyor, the pivotal connection of each of the plates to the plates to adjacent thereto, the cups disposed in each of the plates of the conveyor, and the means for enabling the closing of the bottom portion of each of the cups to release the predetermined portion of the product to a container.

As shown in FIG. 1, apparatus 30 of the invention includes endless conveyor 31 having a plurality of flat plates 32 with the upper surface 32*a* and the bottom surface 32*b* of each plate being disposed in substantially horizontal planes. As shown in FIG. 2, means are provided for pivotally connecting each of the plurality of plates 32 to the plates adjacent thereto including link 33 having an end 33*a* connected to plate 32 and an end 33*b*. Pivot 34 is pivotally connected to each of the adjacent ends 33*a* and 33*b* of links 33. Rollers 35 are pivotally mounted on each of pins 34.

As shown in FIG. 1, each of plates 32 has a leading convex edge portion 32*c* and trailing concave edge portion 32*d*. Edge portions 32*c* and 32*d* are portions of a circle which enables the edge portions to slide with respect to one another as the plates advance around the semicircular end portions 31*a* and 31*b* of endless conveyor 31.

As shown in FIG. 1, the means for driving the endless conveyor 31 in a substantially horizontal plane comprises a sprocket having a plurality indentations 36*a* disposed in the periphery of the sprocket for engagement with rollers 35 of the endless conveyor 31 for driving the endless conveyor. Hub 36*b* of the sprocket is connected to a drive or power source (not shown). As shown in FIGS. 1 and 2, plates 32 pivot with respect to one another in the semicircular end portions of endless conveyor by virtue of the attachment of each plate to end 33*a* of a link 33 and the attachment of each of the links 33 to links adjacent thereto.

Figure 4:
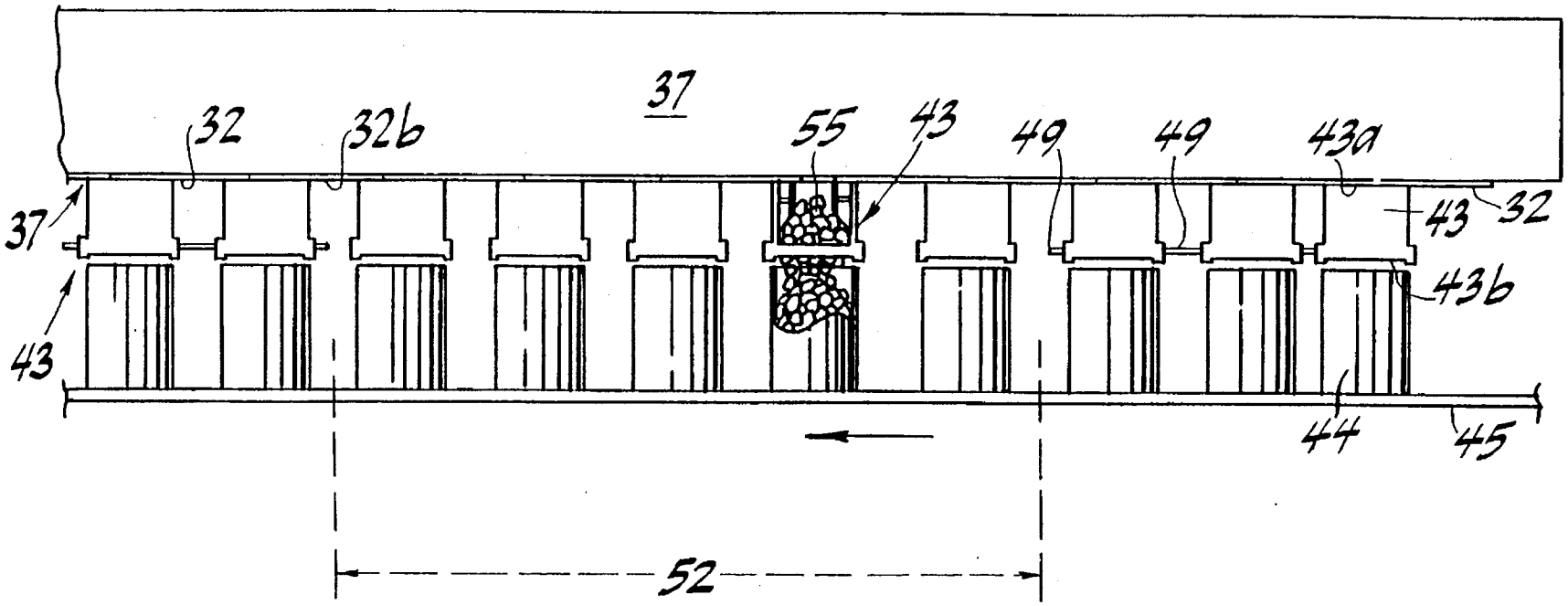
FIG. 4 is a fragmentary elevation view showing fences extending along the endless conveyor for confining product to the upper service of the plates of the conveyor, a plurality of cups having a predetermined volume within each cup, and the release of the predetermined portion of the product from one of the cups to one of the containers.

As shown in FIGS. 1 and 4, means 37 are provided which extend along the path of travel of each of the opposite sides of the endless conveyor 31 and adjacent the upper surface 32*a* of each of the flat plates 32 for confining product such as food product which is delivered to the endless conveyor 31 by a delivering means such as chute or belt 38. Means 37 for confining product upon the plates 32 as the conveyor 31 is driven car comprise fence 37 and fence 39 which extend along the entire path of travel of the conveyor 31 adjacent the opposite straight edge portions 32*e* and 32*f* of each plates 32.

As shown in FIG. 1 each of plates 32 has opening 40 extending therethrough from the top portion 32*a* of each plate to the bottom portion of 32*b* thereof. The openings are adapted to receive products delivered to plates 32 by chute or belt 38 and to enable the products to pass through the openings.

As shown in FIG. 1 the product on plates 32 approaching wiper 41 from the left as viewed in FIG. 1 is deflected toward fence 39. Wiper 42 as shown in FIG. 1 receives product on the left surface of the wiper as viewed in FIG. 1 and directs the product across the plates 32 toward openings 40 therein. As shown in FIG. 4 a plurality of cups 43 having open top portion 43*a* and open bottom portion 43*b* are mounted on the lower surface 32*b* of each plates 32 in alignment with opening 40 in the plates. As shown in FIGS. 1 and 4, means are disposed beneath the path of travel of the plurality of cups 43 attached to plates 32 of endless conveyor 31 for advancing a plurality of empty containers 44 to receive the predetermined portion of product to be delivered to each container by cups 43. The means for advancing the plurality of containers includes conveyor 45 which is driven in the direction of the arrow in FIG. 1 by apparatus (not shown) beneath a portion of endless conveyor 31. The timing of conveyor 45 delivers containers 44 to be aligned with cups 43 extending beneath plates 32 of endless conveyor 31. As a result, each of the containers 44 is made available to receive a predetermined portion of product from each of cups 43.

Figure 5:
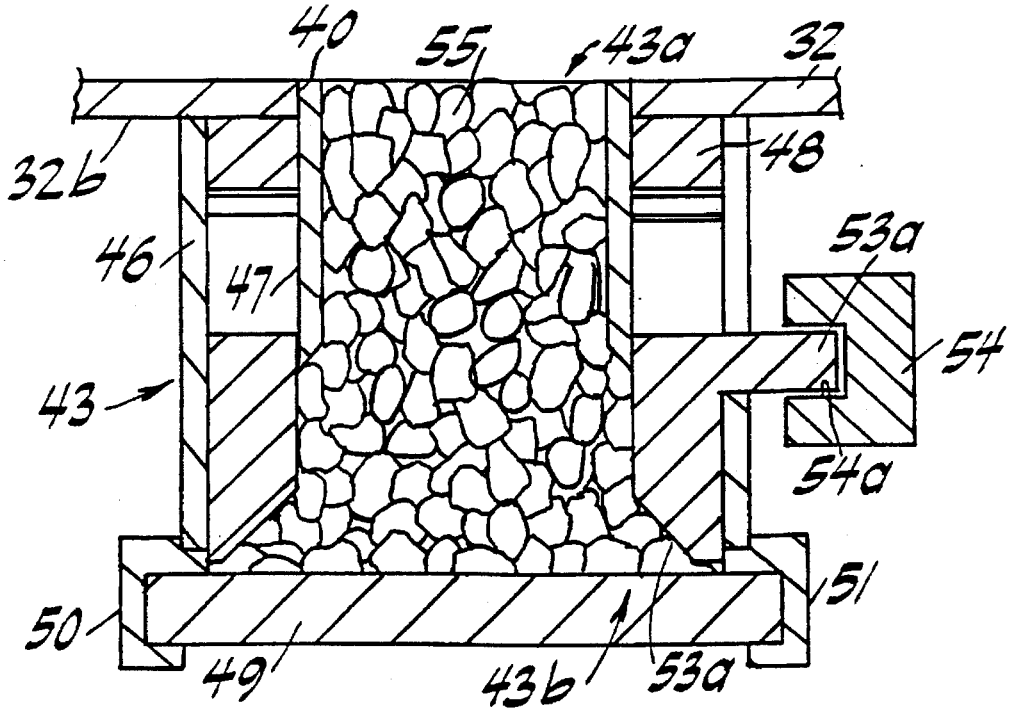
FIG. 5 is a vertical section view showing a cylindrical sleeve disposed in a cup for adjusting the predetermined volume within the cup and means for determining the vertical position of the cylindrical sleeve and thereby the predetermined volume in the cup when the sleeve is in it's bottommost position.
Figure 6:
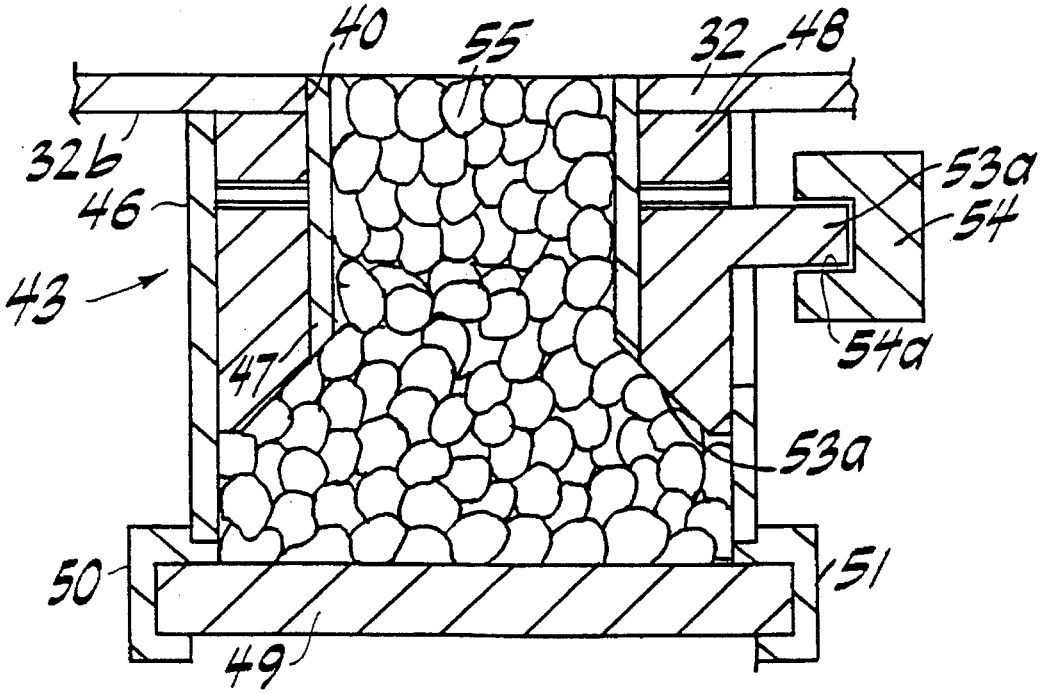
FIG. 6 is a vertical section view of a movable cylindrical sleeve within a cup with the sleeve positioned in its uppermost position within the cup to provide the maximum volume of product within the cup.

An embodiment of cup 43 is shown in FIGS. 4, 5, and 6. As shown in FIGS. 5 and 6, each cup 43 includes outer shell 46 extending downwardly from the lower surface 32*b* of plate 32 and inner shell 47 extending downwardly from opening 40 in each of plates 32. Ring 48 supports the upper ends of shells 46 and 47 with respect to one another and the bottom surface of plate 32. As shown in FIGS. 5 and 6, the means for closing the bottom portion of the plurality cups 43 can comprise deadplate 49 which extends beneath the path of travel of the cups throughout the extent of the endless conveyor 31. Flanges 50 and 51 of each cup 43 engaged and align the cups with respect to deadplate 49. The deadplate 49 is interrupted in the delivery zone 52 shown in FIGS. 1 and 4, thereby uncovering the bottom portion 43*b* of each of the cups 43 and enabling the portion of product to descend into the empty containers 44 below. The interruption to deadplate 49 extends along the path of travel of cups 43 to the extent identified as item 52 in FIGS. 1 and 4.

As shown in FIGS. 5 and 6, cups 43 are each provided with spacer 53 slidable mounted within outer shell 46 and with respect to inner shell 47. Spacer 53 is provided with projection 53*a* extending from the upper portion of the spacer. Projection 53*a* is engaged with groove 54*a* of track 54. As shown in FIGS. 5 and 6, track 54 extends about the entire periphery of endless conveyor 31 and accordingly engages the projections of the cups 43 throughout their travel by way of the endless conveyor 31. Means (not shown) in FIGS. 5 and 6 adjustable determines the vertical or elevational position of track 54 and thereby the position of spacer 53.

In the position of track 54 as shown in FIG. 5, spacer 53 is at its bottommost position with respect to outer shell 46 and inner shell 47. Accordingly there is a minimum volume beneath cone-shaped surfaces 53*a* of spacer 53 and thereby the minimum predetermined volume for product within the cup. In FIG. 6, track 54 elevates spacer 53 to its uppermost position with respect to outer shell 46 and inner shell 47 and, as a result, a maximum predetermined volume is formed beneath the cone-shaped surfaces 53*a* of spacer 53. It can be seen that the positioning of track 54 and the engagement of groove 54*a* with projection 53*a* serves to elevate the spacer to its uppermost position.

As shown in FIG. 1, wiper 56 is positioned with respect to fence 37 and adjacent to upper surface 32*a* of plates 32 to direct product 55 from chute 38 toward fence 39 in order that the product is accumulated adjacent fence 39. Wiper 56 thereafter deflects the product toward fence 37 at the outer periphery of the path of travel of plates 32 in order to insure that the product continues to enter into openings 40 in the plates and thereby subsequently into cups 43 below the openings.

As the plates approach the region of conveyor 45 for containers 44 as shown in FIG. 1, wiper 57 extending along the length of the path of travel of the plates captures the remaining product which has not entered openings 40 and deflects the product toward fence 39. In this way the product which has entered openings 40 and thereby cups 43 is free to be released to the containers 44 as they pass through region 52 shown in FIG. 1. Beyond region 52, wiper 57 extends to the mid-point of the semicircular end portion 31*b* of the endless conveyor. Adjacent the end portion 57*b* of wiper 57, there is disposed wiper 58 extending outwardly from fence 39 and across the path of travel of plates 32. Wiper 58 urges the remaining product on plates 32 to move outwardly toward openings 40 and fence 37. Thereafter wiper 41 extending inwardly with respect to fence 37 deflects the remaining product toward fence 39 prior to the arrival of fresh product from chute 38.

Figure 8:
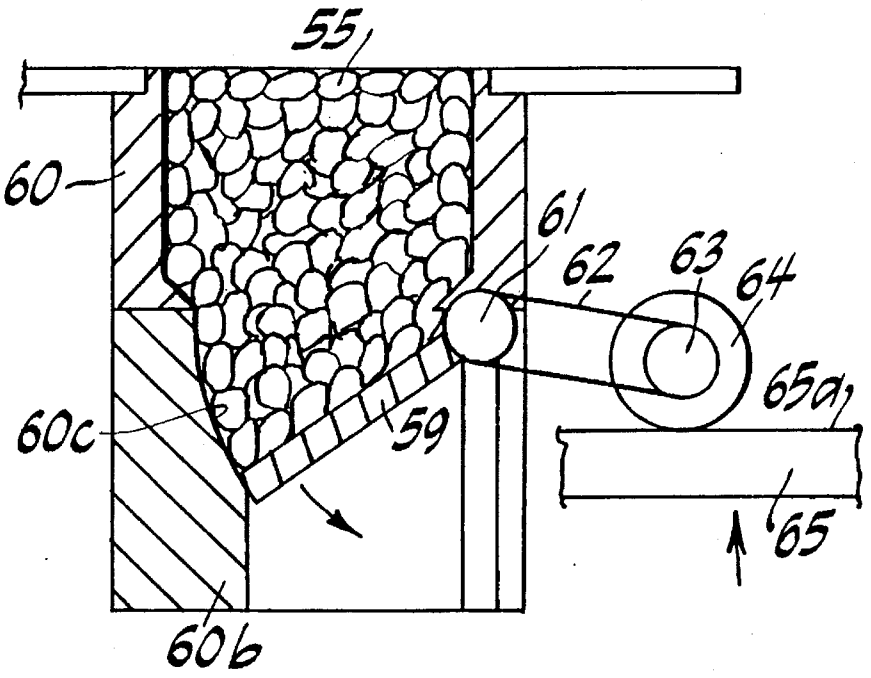
FIG. 8 is a fragmentary vertical section view showing a pivoting gate for closing the bottom portion of each of the plurality of cups to receive a maximum portion of product and the linkage for enabling the closing means to release the predetermined portion of product of each of the cups to a different one of the plurality of containers.
Figure 7:
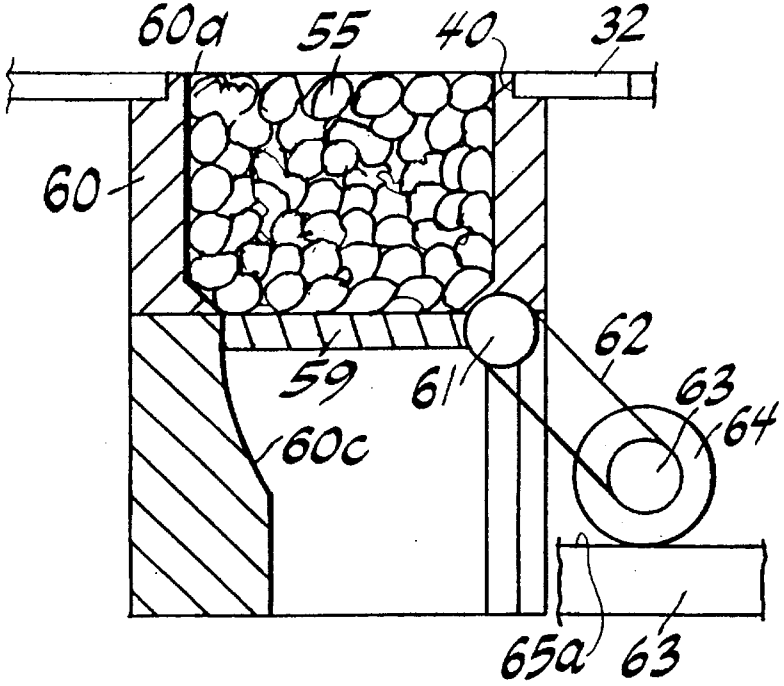
FIG. 7 is a fragmentary vertical section view showing a pivoting gate for closing the bottom portion of each of the plurality of cups to receive a minimum portion of product and the linkage for enabling the closing means to release the predetermined portion of product of each of the cups to different one of the plurality of containers.

In FIGS. 7 and 8 there is shown another embodiment of the means for closing the bottom portion of each of the plurality of cups, i.e. gate 59 disposed in cup 60 as shown in FIGS. 7 and 8. Cup 60 at the open upper portion thereof 60*a* is disposed in registry with opening 40 in plate 32 of the endless conveyor 31. Gate 59 is pivotally supported by shaft 61 mounted in cup 60. Shaft 61 is connected by arm 62 to pivot 63 upon which roller 64 is mounted. Roller 64 travels along track 65 which extends about the outer periphery of endless conveyor 31. In FIG. 7, track 65 is positioned at a level which positions gate 59 at its upper most position, thereby establishing the minimum volume of the cup for receiving product. The weight of arm 62 and roller 64 are sufficient to bias gate 59 into the position shown in FIG. 7. By elevating track 65, the rest position of gate 59 can be lowered with respect to curved surface 60*c* to establish an increase in volume within cup 60 to receive a portion of product 55. In FIG. 8 the track 65 is in an elevated position at which gate 59 establishes the maximum volume of product to be received by cup 60. Elevation of track 65 above the position shown in FIG. 8 causes gate 59 to leave curved surface 60*c* and thereby release the portion of product to pass through openings 60*b* of the cup and thereafter into a container being advanced beneath the cup.

Figure 9:
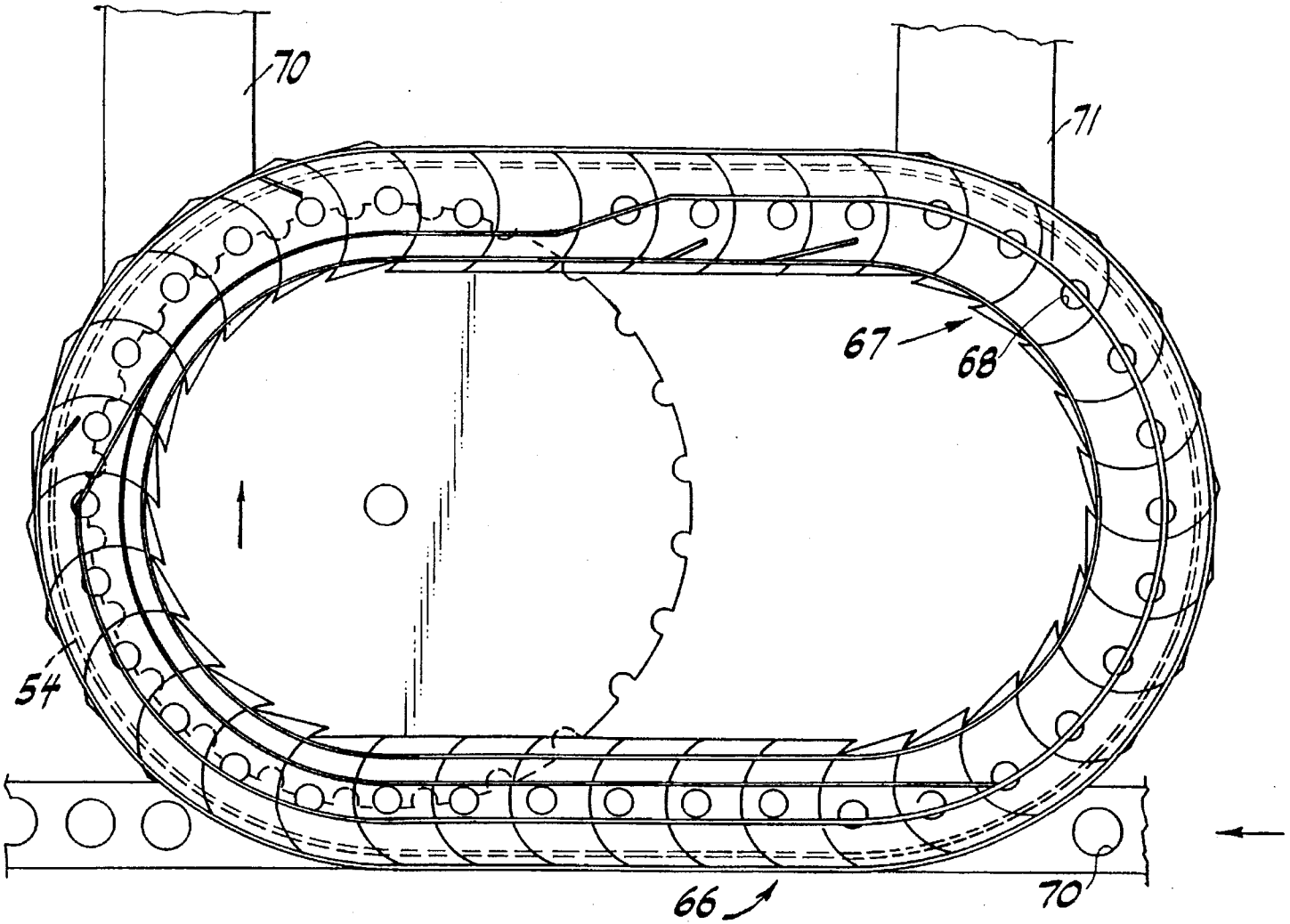
FIG. 9 is a plan view of another embodiment of the endless conveyor of the apparatus of the invention in which the openings within each plate of the endless conveyor are centrally located, in which the cups in register with the openings are centrally located in each plate, in which there is plurality of means for delivering a product to the upper surfaces of the plates of the endless conveyor, and in which there are wipers for directing the product from each of the delivering means sequentially to the openings in the plates of the endless conveyor.

The upper surface track 65*a* of track 65 upon which roller 64 travels can be grained or corrugated to cause vibration of the roller 64 as it travels over the upper surface of the track. The resulting vibration of roller 64 by the corrugated surface 65*a* is transmitted by arm 62 to shaft 61 attached to gate 59 and thereby vibrates the gate and induces vibration through the product within the cup. Such vibration produces a more uniform density of product within the cup resulting in a more accurate portion of product in each cup for delivering to a container. In FIG. 9 endless conveyor 66 having plates 67 pivotally connected to one another contains openings 68 centrally located in each of the plates. Apparatus 66 shown in FIG. 9 includes a pair of means for delivering product to the upper surfaces of the plates of the endless conveyor, i.e. chutes or belts 70 and 71. By way of example, the product delivered by each of chutes 70 and 71 can be different materials, such as, for example, different food products which would be introduced into a single container 70.

What is claimed is:

1. Apparatus for delivering a predetermined quantity of product to each of a plurality of containers comprising:

an endless conveyor having a plurality of flat plates adjacent to one another with the upper surface of each plate disposed in a substantially horizontal plane;

means for pivotally connecting each of the plurality of plates to the plates adjacent thereto;

means for driving the conveyor in the substantially horizontal plane;

means extending along the length of each of the opposite sides of the endless conveyor adjacent the upper surface portion of each plate for confining product upon the upper surface of the plates as the conveyor is driven;

each of the plates of the conveyor having an opening extending therethrough from the top portion of each plate to the bottom portion thereof;

a plurality of cups having an open top portion, an open bottom portion, and a predetermined volume within each cup, each different cup being disposed on a different one of the plates with the open top portion of the cup in register with the opening in the plate;

means for closing the bottom portion of each of the plurality of cups;

means disposed at a predetermined location along the path of travel of the endless conveyor for delivering product to the upper surfaces of the plates of the endless conveyor between the product confining means;

means disposed beneath the path of travel of the bottom portion of each of the plurality of cups and extending along a portion of the length of the path of travel of the endless conveyor at a distance from the means for delivering product to the upper surfaces of the plates of the endless conveyor for advancing a plurality of containers each to receive the predetermined quantity of product; and means for enabling the closing means for the bottom portion of each of the plurality of cups to release the predetermined quantity of product of each of the plurality of cups to a different one of the plurality of containers.

2. Apparatus in accordance with claim 1 in which the endless conveyor has a pair of oppositely disposed semicircular end portions and a pair of oppositely disposed straight portions each connected to a different end of the semicircular end portions to form an elongated loop.

3. Apparatus in accordance with claim 1 in which the endless conveyor has a plurality of links each underlying a different plate of the plurality of plates and extending in the direction of the endless conveyor, each of the opposite ends of each link being connected by a pivot to the end of a link adjacent thereto, and in which the means for pivotally connecting each of the plurality of plates to the plates adjacent thereto includes connecting each of the plurality of plates to a different one of the pivotally connected links.

4. Apparatus in accordance with claim 3 in which the means for driving the conveyor in the substantially horizontal plane includes a sprocket having a plurality of indentations about the periphery thereof for engaging and advancing the plurality of links of the endless conveyor, and means for rotating the sprocket to drive the endless conveyor.

5. Apparatus in accordance with claim 1 in which each of the plurality of flat plates has a leading convex edge portion and a trailing convex edge portion with each edge portion being nested with respect to the edge portion of the plate adjacent thereto.

6. Apparatus in accordance with claim 1 in which the means extending along the length of each of the opposite side of the endless conveyor adjacent the upper surface portion of each plate for confining product upon the upper surface of the plates as the conveyor is driven comprises a pair of oppositely disposed fences extending upwardly from the substantially horizontal plane of the endless conveyor.

7. Apparatus in accordance with claim 1 in which the means for closing the bottom portion of each of the plurality of cups includes a deadplate underlying the path of travel of the open bottom portion of each of the plurality of cups with the travel of the plates of the endless conveyor, the dead plate extending across the open bottom portion of each of the plurality of cups to maintain the bottom portion closed, and in which the means for enabling the closing means for the bottom portion of each of the plurality of cups to release the predetermined quantity of product of each of the plurality of cups to a different one of the plurality of containers includes an interruption in the extent of the deadplate overlying the means for advancing a plurality of containers each to receive the predetermined quantity of product.

8. Apparatus in accordance with claim 1 in which the means for closing the bottom portion of each of the plurality of cups includes a gate movably mounted adjacent to the bottom portion of each of the different cups of the plurality of cups, each gate being movable between a position closing the bottom portion of the cup and a position opening the bottom portion of the cup, and in which the means for enabling the closing means for the bottom portion of each of the plurality of cups to release the predetermined quantity of product of each of the plurality of cups to a different one of the plurality of containers includes means for sequentially opening the gate from a position closing the bottom portion of the cup to a position opening the bottom portion of the cup and returning the gate to a position closing the bottom portion of the cup.

9. Apparatus in accordance with claim 1 and further comprising means disposed in each of the of the plurality of cups for adjusting the predetermined volume within each cup.

10. Apparatus in accordance with claim 9 in which the means for adjusting the predetermined volume within each cup comprises a movable cylindrical sleeve disposed within each cup,the vertical position of the sleeve determining the predetermined volume within the cup from a maximum to a minimum predetermined volume.

11. Apparatus in accordance with claim 10 in which the movable cylindrical sleeve within each cup includes a projection extending therefrom and means extending along the path of travel of the cup and engaging the projections for determining the vertical position of the movable cylindrical sleeve within each cup and thereby the predetermined volume therein.

12. Apparatus in accordance with claim 11 in which the means engaging the projections extending from the cups for determining the vertical position of the movable cylindrical sleeve comprises a track for engaging the projections and means for adjustable maintaining the elevation of the track with respect to the path of travel of the cups to determine the vertical position of the projections and thereby that of the cylindrical sleeves to obtain the predetermined volume within each cup.

13. Apparatus in accordance with claim 1 in which the means for closing the bottom portion of each of the plurality of cups includes a gate movably mounted adjacent to the bottom portion of each of the different cups of the plurality of cups, each gate being movable between a plurality of a different vertically disposed upper positions for closing the bottom portion of a different one of the cups, each of the plurality of different vertically disposed upper positions establishing a different predetermined volume within each cup, each gate having a lower position opening the bottom portion of the cups, and in which the means for enabling the closing means for the bottom portion of each of the plurality of cups to release the predetermined quantity of product of each of the plurality of cups to a different one of the plurality of containers includes means for sequentially opening the gate from one of the plurality of upper positions closing the bottom portion of a cup to the lower position opening the bottom portion of the cup and for returning the gate to one of the plurality of upper positions closing the bottom portion of the cup.

14. Apparatus in accordance with claims 13 in which the gate is pivotally mounted by a shaft with respect to the cup, an arm extending at an angle from the shaft for rotating the shaft and thereby the gate, the arm having a free end portion disposed opposite the gate, a track having a first portion extending parallel to the path of travel of the cups and beneath the path of travel of the free end portion of the arms for engagement therewith, means for adjustably setting the vertical position of the track, the vertical position of the track by engagement with the free end portion of the arm determining the one of a plurality of different vertically disposed upper positions of the gate, the track having a second portion extending parallel to the path of travel of the cups and beneath the path of travel of the free end portions of the arms, means for setting a lower vertical position of the second portion of the track to enable the arm of each cup to move to a lower position at which the arm moves the gate to the lower position thereby opening the cup.

15. Apparatus in accordance with claim 14 in which the free end portion of each arm has a roller pivotally mounted thereon, the roller engaging the first and second portions of the track to operate the arm and thereby the gate.

16. Apparatus in accordance with claim 15 in which the first portion of the track has a textured surface in engagement with the roller to vibrate the roller and thereby the arm and the cup and the product in the cup to insure that the predetermined portion of product is contained in the cup.

17. Apparatus in accordance with claim 16 in which the textured surface of the track is a corrugated surface.

18. A method for delivering a predetermined quantity of product to each of a plurality of containers by use of an endless conveyor having a plurality of flat plates adjacent to one another with the upper surface of each plate disposed in a substantially horizontal plane, each of the plurality of plates being pivotally connected to the plates adjacent thereto, the conveyor being adapted to be driven in the substantially horizontal plane, a fence extending along the length of each of the opposite sides of the endless conveyor adjacent the upper surface portion of each plate for confining product upon the upper surface of the plates as the conveyor is driven, each of the plates of the conveyor having an opening extending therethrough from the top portion of each plate to the bottom portion thereof, a plurality of cups having an open top portion, an open bottom portion, and a predetermined volume within each cup, each different cup being disposed on a different one of the plates with the open top portion of the cup in register with the opening in the plate, and a closing device for closing the bottom portion of each of the plurality of cups, the method comprising the steps of:

driving the endless conveyor in the substantially horizontal plane along a path of travel and thereby the bottom portion of each of the plurality of cups along another path of travel extending parallel to and spaced from and beneath the path of travel of the conveyor, delivering product to the upper surfaces of the plates of the endless conveyor at a predetermined location along the path of travel of the endless conveyor, directing the product being delivered to the upper surfaces of the plates of the endless conveyor to pass through the opening in the plates and to enter the open top portion of each of the plurality of cups and fill each of the plurality of cups with the predetermined portion of product, advancing along an additional path of travel a plurality of containers each having an open upper portion to receive the predetermined portion of product from a different one of the plurality of cups, the additional path of travel of the containers extending beneath a portion of the length of the path of travel of the endless conveyor with the open upper portion of each of the plurality of containers being beneath a portion of the other path of travel of the bottom portions of the plurality of cups, and enabling the closing device for the bottom portion of each of the plurality of cups to release the predetermined portion of product of each of the plurality of cups to a different one of the plurality of containers.

19. A method in accordance with claim 18 in which the step of driving the endless conveyor in the substantially horizontal plane includes driving the conveyor by engagement with the pivotal connections of the plates of the endless conveyor for advancing the endless conveyor.

20. A method in accordance with claim 18 in which the step of enabling the closing device for the bottom portion of each of the plurality of cups to release the predetermined portion of product includes the step of providing a deadplate underlying the path of travel of the open bottom portion of each of the plurality of cups with the travel of the plates of the endless conveyor, the dead plate extending across the open bottom portion of each of the plurality of cups to maintain the bottom portion closed, and in which the step of enabling the closing device for the bottom portion of each of the plurality of cups to release the predetermined quantity of product of each of the plurality of cups to a different one of the plurality of containers further includes providing an interruption in the extent of the deadplate overlying the advancing plurality of containers to release a predetermined portion of product to each container.

21. A method in accordance with claim 18 which the step of enabling the closing device for the bottom portion of each of the plurality of cups includes providing a gate movably mounted adjacent to the bottom portion of each of the different cups of the plurality of cups, moving each gate between a position closing the bottom portion of the cup and a position opening the bottom portion of the cup, and in which the step of enabling the closing of the bottom portion of each of the plurality of cups to release the predetermined quantity of product of each of the plurality of cups to a different one of the plurality of containers further includes sequentially opening the gate from a position closing the bottom portion of the cup to a position opening the bottom portion of the cup and returning the gate to a position closing the bottom portion of the cup.

22. A method in accordance with claim 18 and further comprising the step of adjusting the predetermined volume within each of the plurality of cups.

23. A method in accordance with claim 22 in which the step of adjusting the predetermined volume within each cup comprises providing a movable cylindrical sleeve within each cup, and setting the vertical position of the sleeve for determining the predetermined volume within the cup from a maximum predetermined volume to a minimum predetermined volume.

24. A method in accordance with claim 23 in which the movable cylindrical sleeve within each cup includes a projection extending therefrom and further comprising the step of engaging the projections along the path of travel of each cup for determining the vertical position of the movable cylindrical sleeve within each cup and thereby the predetermined volume therein.

25. A method in accordance with claim 24 in which the step of engaging the projections extending from the cups for determining the vertical position of the movable cylindrical sleeve comprises the step of providing a track for engaging the projections and the step of adjustable maintaining the elevation of the track with respect to the path of travel of the cups to set the vertical position of the projections and thereby that of the cylindrical sleeves for determining the predetermined volume within each cup.

26. A method in accordance with claim 18 which the step of enabling the closing device for the bottom portion of each of the plurality of cups includes providing a gate movably mounted adjacent to the bottom portion of each of the different cups of the plurality of cups, moving each gate between one of a plurality of upper positions closing the bottom portion of the cup and a lower position opening the bottom portion of the cup, and in which the step of enabling the closing of the bottom portion of each of the plurality of cups to release the predetermined quantity of product of each of the plurality of cups to a different one of the plurality of containers further includes sequentially opening the gate from one of the plurality of upper positions closing the bottom portion of the cups to a lower position opening the bottom portion of the cup and returning the gate to one of the plurality of upper positions closing the bottom portion of the cup.

27. A method in accordance with claim 26 and further comprising the step of vibrating each cup to insure vibrating each cup to insure that the predetermined portion of product is received therein.

28. A method in accordance with claim 18 and further comprising one of the plurality of the upper portions of the gate adjusting the predetermined volume within each of the plurality of cups.

29. A method in accordance with claim 18 in which the step of moving each gate comprises rotating each gate between one of a plurality of upper positions closing the bottom portion of the cup and a lower position opening the bottom portion of the cup.

30. A method in accordance with claim 18 in which the movable gate within each cup includes an arm extending therefrom and further comprising the step of engaging the arm along the path of travel of each cup for determining the vertical position of the movable arm and thereby the gate within each cup and the predetermined volume therein.

31. A method in accordance with claim 30 in which the step of engaging the arm extending from the cups for determining the vertical position of the movable gate comprises the step of providing a track for engaging the arm and the step of adjustably establishing the elevation of the track with respect to the path of travel of the cups to set the vertical position of the arm and thereby that of the gate determining the predetermined volume within each cup.

* * * * *